US009322531B2

(12) United States Patent
Liang et al.

(10) Patent No.: US 9,322,531 B2
(45) Date of Patent: Apr. 26, 2016

(54) LED LAMP

(71) Applicant: HON HAI PRECISION INDUSTRY CO., LTD., New Taipei (TW)

(72) Inventors: Chun-Wei Liang, New Taipei (TW); Kuang-Ming Hsiao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 69 days.

(21) Appl. No.: 14/460,648

(22) Filed: Aug. 15, 2014

(65) Prior Publication Data

US 2015/0292681 A1 Oct. 15, 2015

(30) Foreign Application Priority Data

Apr. 15, 2014 (CN) ..... 2014 1 01498245

(51) Int. Cl.

| | |
|---|---|
| ***F21S 4/00*** | (2006.01) |
| ***F21V 21/00*** | (2006.01) |
| ***F21V 19/00*** | (2006.01) |
| ***F21V 23/02*** | (2006.01) |
| ***F21K 99/00*** | (2010.01) |
| ***F21V 23/06*** | (2006.01) |
| ***H01R 33/00*** | (2006.01) |
| *F21Y 103/00* | (2006.01) |
| *F21Y 101/02* | (2006.01) |

(52) U.S. Cl.

CPC ..... *F21V 19/003* (2013.01); *F21K 9/175* (2013.01); *F21V 19/0035* (2013.01); *F21V 23/02* (2013.01); *F21V 23/06* (2013.01); *H01R 33/00* (2013.01); *F21Y 2101/02* (2013.01); *F21Y 2103/003* (2013.01)

(58) Field of Classification Search

CPC ..... F21K 9/17; F21K 9/175; F21V 19/003
USPC ..... 362/217.1–217.17, 225, 249.02, 362/311.02, 800
See application file for complete search history.

(56) References Cited

U.S. PATENT DOCUMENTS

2013/0182407 A1 7/2013 Wu

FOREIGN PATENT DOCUMENTS

TW M457835 U1 7/2013

*Primary Examiner* — Jason M Han
(74) *Attorney, Agent, or Firm* — Novak Druce Connolly Bove + Quigg LLP

(57) ABSTRACT

An LED lamp includes a tube and a light bar received in the tube. The tube includes a base and a lamp window. A lengthwise first slot is defined on a center bottom of the base. The light bar includes a first surface, an opposite second surface, a first side and an opposite side. The first side and the second side are respectively coupled with the first surface and the second surface. Several light emitting diodes are mounted on at least one of the first surface or the second surface. The first side of the light bar is inserted into the first slot of the base. The second side of the light bar is close to a center bottom of the lamp window.

12 Claims, 6 Drawing Sheets

LED LAMP

FIELD

The disclosure relates to a lighting device, and particularly relates to a light emitting diode lamp.

BACKGROUND

A lighting device is used for generating light and illuminating places, such as shopping malls, home, parking lots and so on.

BRIEF DESCRIPTION OF THE DRAWINGS

Implementations of the present technology will now be described, by way of example only, with reference to the attached figures.

DETAILED DESCRIPTION

Figure 1:
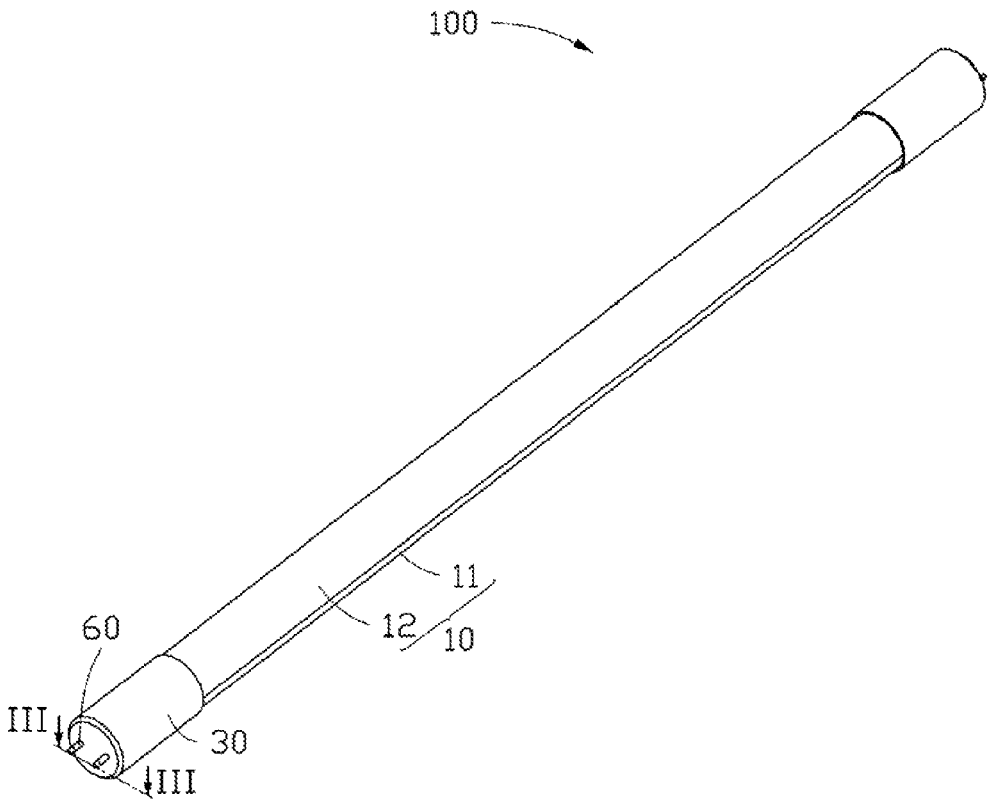
FIG. 1 is an assembled, isometric view of an LED lamp in accordance with an exemplary embodiment of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Figure 2:
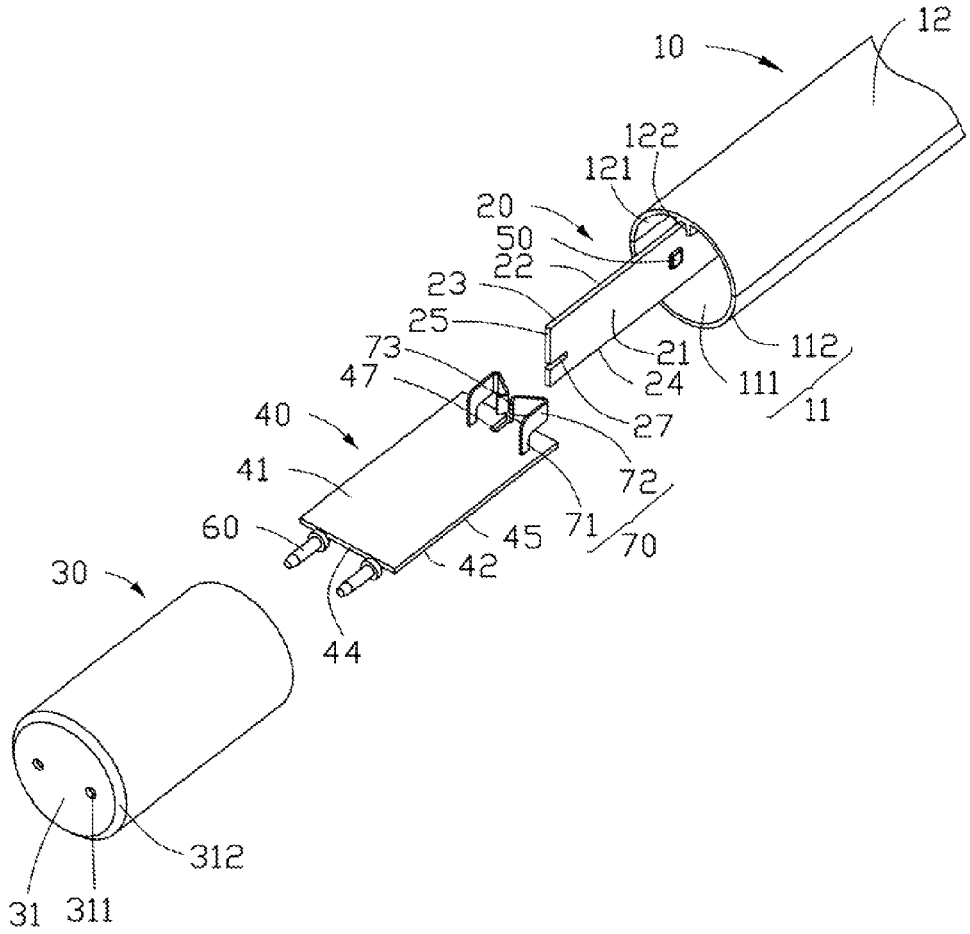
FIG. 2 is a partially exploded, isometric view of the LED lamp in FIG. 1.

Referring to FIG. 1 and FIG. 2, the present LED lamp 100 is a strip cylinder and is symmetrically designed with a central axis of the cylinder. The LED lamp 100 includes a tube 10, a light bar 20 received in the tube 10, two lamp holders 30 located at two ends of the tube 10, and two power boards 40 received in the lamp holders 30, respectively.

Figure 4:
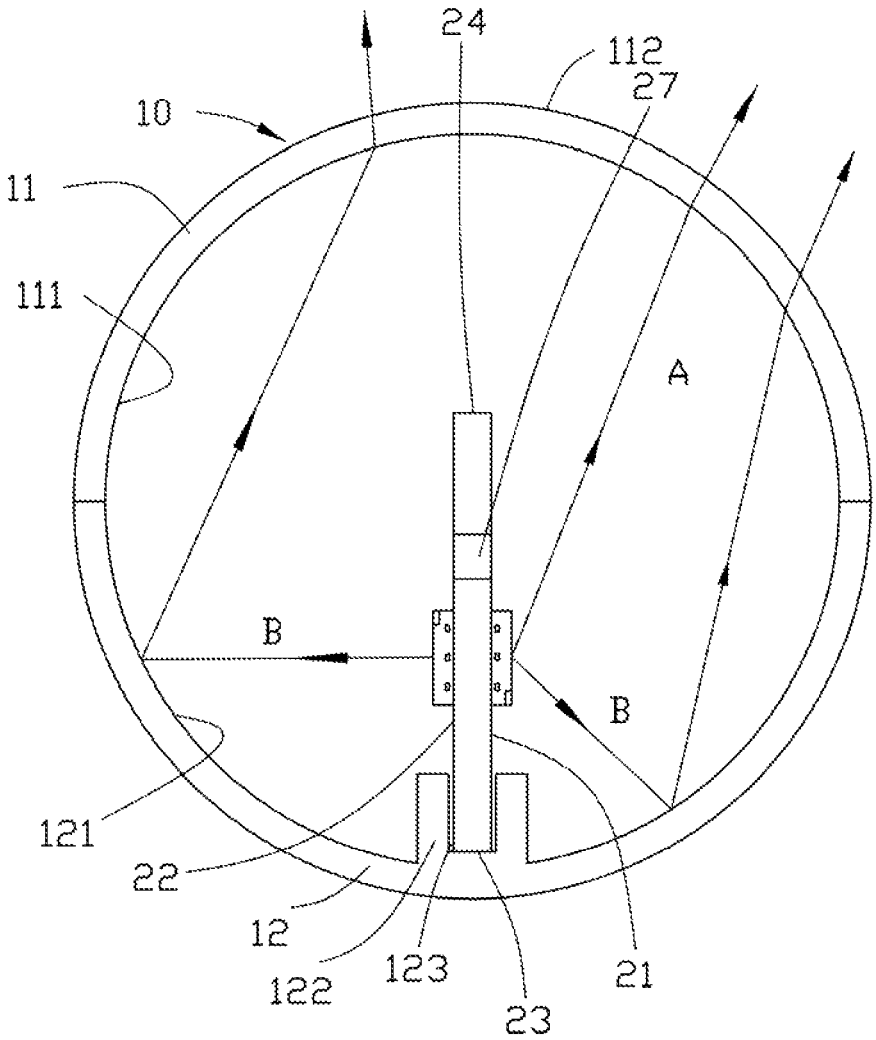
FIG. 4 is an assembled, isometric view of a light bar and a tube of the LED lamp in FIG. 1.

The tube 10 can be made of PC plastics with two colors. The tube 10 includes a lamp window 11 and a base 12. In other embodiments, the lamp window 11 and the base 12 can be integrative. A shape of the lamp window 11 is substantially corresponding to that of the base 12. In this embodiment, the lamp window 11 and the base 12 have an identical shape and cooperate to form a cylinder configuration. A joint surface of the lamp window 11 and the base 12 is in a virtual plane. It can be appreciated that in other embodiments the tube 10 can also have other shapes. For example, a cross-section along an axis of the tube 10 can be a polygon or an optical free-form surface. The lamp window 11 can be made of translucent PC plastics. The lamp window 11 includes a light incident surface 111 and a light outputting surface 112. As shown in FIG. 4, the light incident surface 111 is a semicircular arc and the light outputting surface 112 is a semicircular arc concentric with the light incident surface 111. The base 12 is made of white PC plastic. The base 12 includes a dispersion surface 121 and two flanges 122. The dispersion surface 121 is semicircle-shaped. The flanges 122 are formed at a center bottom of the base 12 along a lengthwise direction of the tube 10. The two flanges 122 are spaced from each other with a first slot 123 defined therebetween. The first slot 123 is used for fixing the light bar 20.

Figure 3:
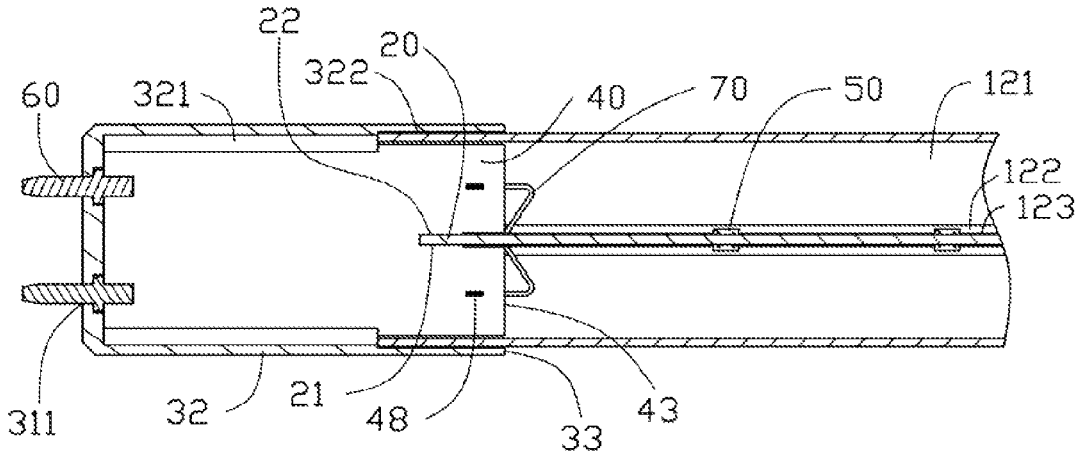
FIG. 3 is a cross-sectional view of a portion of the LED lamp in FIG. 1, taken along a line III-III thereof.

Referring to FIG. 2 and FIG. 3, the light bar 20 is a lengthwise plate. The light bar 20 can be made of aluminum (Al). It can be appreciated that in other embodiments the light bar 20 can also be made of cooper, fiberglass, and so on. A length of the light bar 20 is slightly less than that of the tube 10. A width of the light bar 20 ranges from a radius of the tube 10 to a diameter of the tube 10. The light bar 20 includes a first surface 21, an opposite second surface 22, a first side 23, a parallel second side 24, a first end 25, a parallel second end (not shown), and two opposite first gaps 26 defined in the first end 25 and the second end, respectively. The first surface 21 and the second surface 22 are parallel to each other. A plurality of light emitting diodes 50 are mounted on the first surface 21 and the second surface 22 back to back. The light emitting diodes 50 are arranged in a lengthwise row at a center portion of the first surface 21 and the second surface 22, respectively. Each first gap 26 is U-shaped. The first gaps 26 are sunk from the first end 25 and the second end to an opposite side of the light bar 20, respectively. A distance from the first gap 26 to the first side 23 of the light bar 20 is almost equal to a radius of the tube 10. The first gaps 26 are used for fixing the power boards 40 to the light bar 20.

Referring to FIG. 3 and FIG. 4, the light bar 20 is completely received in the tube 10. When the light bar 20 is fixed, the first side 23 of the light bar 20 is inserted into the first slot 123 of the base 12. At this moment, the first surface 21 and the second surface 22 of the light bar 20 are partly clipped by the two flanges 122 of the base 12, respectively. A plane where the light bar 20 located is perpendicular to the joint surface of the lamp window 11 and the base 12. The light emitting diodes 50 are received in the semicircular space defined by the base 12 completely.

Referring to FIG. 4, when the present LED lamp 100 works, light emitted from the light emitting diodes 50 can be distributed in two parts. The two parts are marked as A and B respectively. Light A emits to the light incident surface 111 of the lamp window 11, and then emits out of the light outputting surface 112 of the lamp window 11 directly and positivity. Light B emits to the dispersion surface 121 of the base 12 and is reflected by the dispersion surface 121. Then light B emits to the light incident surface 111 and emits out of the light outputting surface 122 of the lamp window 11, thereby obtaining uniform illumination.

Figure 5:
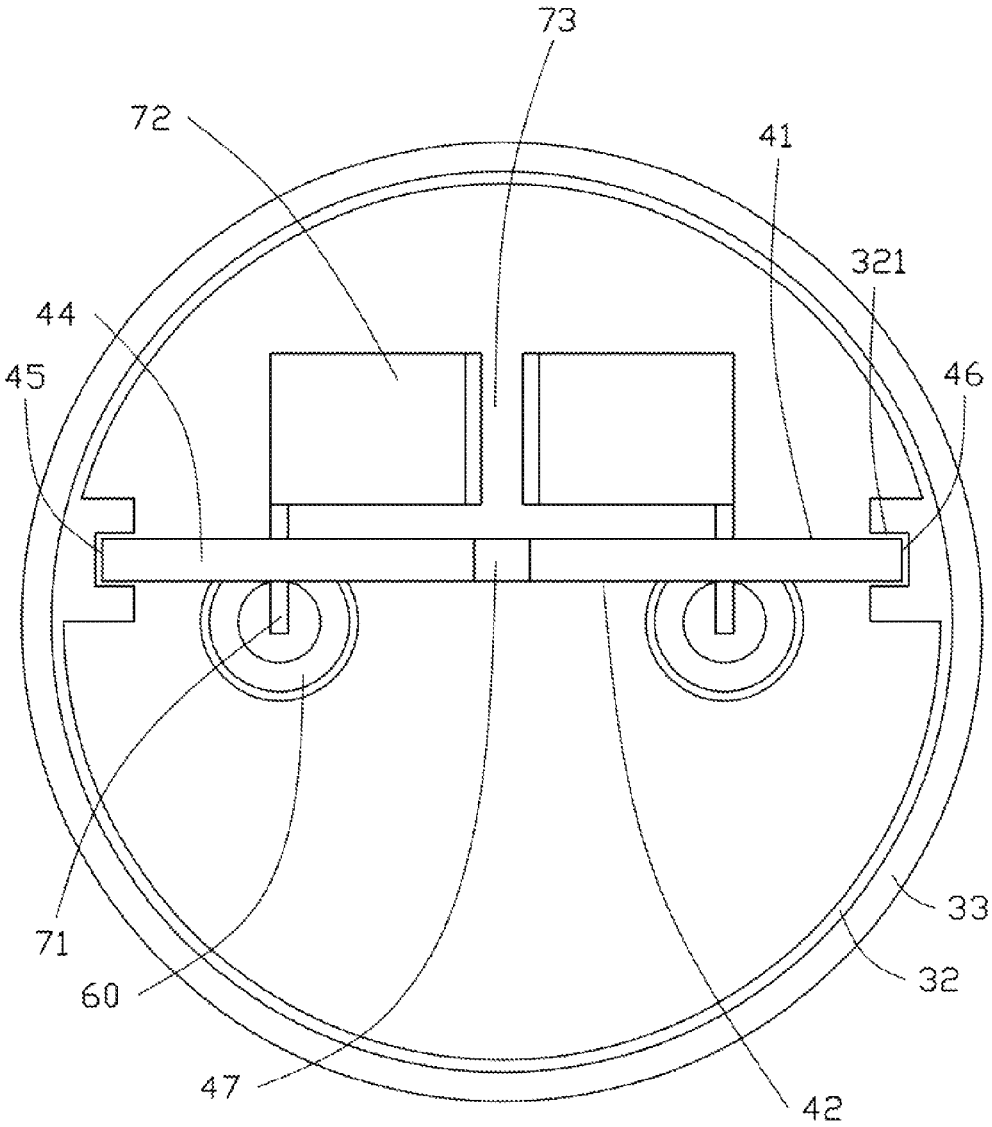
FIG. 5 is an assembled, isometric view of a power board and a lamp holder of the LED lamp in FIG. 1.

Referring to FIG. 2 and FIG. 3 again, the lamp holder 30 can be columnar-shaped. The lamp holder 30 includes a circle end 31, and a wall 32 perpendicularly extended from the end 31 with an opening 33 facing the end 31. Two perforations 311 are separately defined in the end 31. A chamfer angle 312 is formed at a joint portion of the end 31 and the wall 32. Two symmetrical second slots 321 are defined in the inner side of the wall 32 along a lengthwise direction of the lamp holder 30. A shape of the second slot 321 of the wall 32 is the same with that of the first slot 123 of the base 12. The second slot 321 is used for fixing the power board 40 as shown in FIG. 5. The wall 32 further includes a circle surface 322 close to the opening 33. The circle surface 322 is used for connecting the lamp holder 30 to the tube 10. The circle surface 322 wraps the tube 10 closely when the lamp holder 30 is assembled to the tube 10. The connection between the circle surface 322 and the tube 10 can be clearance fit.

Figure 6:
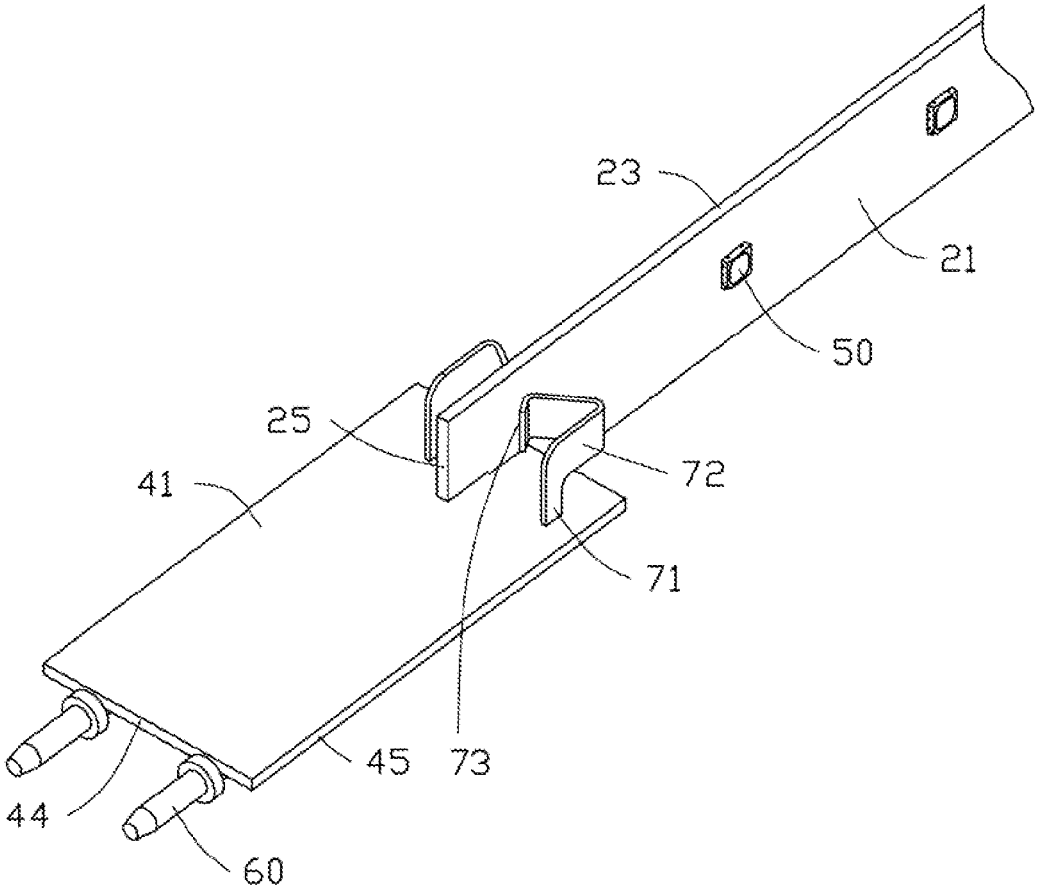
FIG. 6 is an assembled, isometric view of a light bar and a power board of the LED lamp in FIG. 1.

The power board 40 can be a rectangle plate. The power board 40 includes a connecting surface 41, a parallel joint surface 42, a connecting end 43, a parallel joint end 44, a first fixed surface 45, a parallel second fixed surface 46, a second gap 47 and two fixed holes 48. The connecting surface 41 and the joint surface 42 are opposite to each other. The connecting end 43 is located near the light bar 20. Two pins 60 are jointed on the joint end 44. The pins 60 are mounted on the joint surface 42. The pins 60 are connected to the power board 40 electrically. The pins 60 exceed over the joint end 44 to outside of the power board 40. The pins 60 are mounted on the joint surface 42 before the LED lamp 100 is assembled. The second gap 47 of the power board 40 is matched with the first gap 26 of the light bar 20, thereby connecting the power board 40 to the light bar 20 as shown in FIG. 6. The two fixed holes 48 can be rectangle perforations. The fixed holes 48 are defined on the power board 40 and are close to the connecting end 43. The fixed holes 48 are symmetrically located at two sides of the second gap 47, respectively.

Two bending sheets 70 made of iron are fixed on the power board 40 through the two fixed holes 48, respectively. The bending sheet 70 includes a fixed foot 71 and an electric foot 72. The fixed foot 71 is perpendicularly inserted into the fixed hole 48 on the connecting surface 41 of the power board 40. The electric foot 72 is V-shaped. The electric foot 72 is perpendicularly to the fixed foot 71. One of the two fixed feet 71 is close to the other one. A long and narrow groove 73 is defined between the two fixed feet 71. A width of the groove 73 is less than a thickness of the light bar 20.

Referring to FIG. 6, the light bar 20 can be inserted into the groove 73 and is connected to the power board 40 electrically. When the light bar 20 is inserted into the groove 73, the two bending sheets 70 are forced to be elastically deformed and provide inward pressures to fix the light bar 20.

The LED lamp 100 of the embodiment in the present invention is assembled as following:

The two pins 60 are jointed to the joint end 44 of the power board 40 and are mounted on the joint surface 42 of the power board 40. The light bar 20 is inserted into the first slot 123 of the base 12 of the tube 10. The power board 40 is inserted into the second slots 321 of the lamp holder 30. The light bar 20 is connected to the power boards 40 through the first gaps 26 of the light bar 20 and the second gaps 47 of the power boards 40. Two ends of the tube 10 are received in the openings 33 of the lamp holders 30. In this embodiment, glues can be used for connecting the tube 10 to the lamp holders 30.

As shown as FIG. 1, the LED lamp 100 is completely assembled.

In this embodiment of the present invention, side light with lower intensity emitted from the light emitting diodes 50 emits to the light incident surface 111 of the lamp window 11 directly. Positive light with stronger intensity emits to the dispersion surface 121 of the base 12 and is scattered to the light incident surface 111 of the lamp window 11 by the dispersion surface 121, then emits out of the light outputting surface 112 of the lamp window 11. Accordingly, the light with stronger intensity cannot emit into eyes of user directly. In this way, not only will the user not feel uncomfortable in vision, but also a uniform illumination can be obtained.

Furthermore, the LED lamp 100 in the present invention is provided with a simple structure. All the connections in the LED lamp 100 are achieved in insert molds. Such as the insert mode between the light bar 20 and the base 12, the insert mode between the bending sheets 70 and the power board 40, the insert mode between the light bar 20 and the wall 32, the crossed and contrapuntal connection between the light bar 20 and the power board 40 and the connection between the tube 10 and the opening 33. Accordingly, the LED lamp 100 can be produced efficiently.

The embodiment shown and described above is only an example. Many details are often found in the art such as the other features of a tube. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An LED lamp, comprising:

a tube comprising a base having a center bottom, and a lamp window, the center bottom of the base defining a first slot; and a light bar being received in the tube, the light bar comprising:

a first surface;

a second surface opposite the first surface;

a first side;

a second side opposite the first side, the first side and the second side being coupled to the first surface and the second surface respectively, wherein the light bar is a lengthwise plate, a length of the light bar is less than that of the tube, a width of the light bar ranges from a radius of the tube to a diameter of the tube, and a thickness of the light bar corresponds to the first and second sides; and one or more light emitting diodes being mounted on at least one of the first surface or the second surface, the first side of the light bar being inserted into the first slot of the base, and the second side of the light bar facing the lamp window.

2. The LED lamp of claim 1, wherein the base comprises two flanges spaced from each other at the center bottom of the base, the two flanges are extended along a lengthwise direction of the tube, and the first slot is defined between the two flanges.

3. The LED lamp of claim 1, wherein a shape of the lamp window is similar to that of the base.

4. The LED lamp of claim 3, wherein a cross-section of the tube is a circle, a polygon or an optical free-form surface.

5. The LED lamp of claim 1, wherein the light emitting diodes are arranged in a lengthwise row at a center of the first surface and the second surface to allow side light emitted from the light emitting diodes emitting out of the lamp window directly, and the other light emitted from the light emitting diodes being reflected by the base and then emits outside.

6. The LED lamp of claim 1 further comprising two lamp holders and two power boards, the two lamp holder being located at the two ends of the tube, the two power boards being received in the lamp holders, respectively.

7. The LED lamp of claim 6, wherein the lamp holder each is column-shaped, and the lamp holder each comprises an end and a wall extended perpendicularly from the end with an opening facing the end.

8. The LED lamp of claim 7, wherein two symmetrical and lengthwise second slots are defined in the wall to fix the corresponding power board.

9. The LED lamp of claim 7, wherein two perforations are defined in the end of the lamp holder and are spaced from each other.

10. The LED lamp of claim 9, wherein two pins are jointed on the power board, and each pin is inserted in a corresponding perforation of the end of the lamp holder to fix the power board.

11. The LED lamp of claim 6, wherein two bending sheets are formed on the power board with a groove defined therebetween, a second gap is defined in the power board and is close to the light bar, a first gap is defined in one end of the light bar, the first and second gaps intersect with each other, and the light bar is electrically connected to the power board by inserting into the groove.

12. The LED lamp of claim 7, wherein the tube is wrapped by the openings of the lamp holders.

* * * * *